US005970444A

United States Patent [19]

Hayashi et al.

[11] Patent Number: 5,970,444

[45] Date of Patent: Oct. 19, 1999

[54] SPEECH CODING METHOD

[75] Inventors: Shinji Hayashi; Sachiko Kurihara; Akitoshi Kataoka, all of Tokyo, Japan

[73] Assignee: Nippon Telegraph and Telephone Corporation, Tokyo, Japan

[21] Appl. No.: 09/037,993

[22] Filed: Mar. 11, 1998

[30] Foreign Application Priority Data

Mar. 13, 1997 [JP] Japan ..... 9-059466

[51] Int. Cl.[6] ..... G10L 9/14

[52] U.S. Cl. ..... 704/223; 704/219; 704/222

[58] Field of Search ..... 704/223, 219, 704/222, 211

[56] References Cited

U.S. PATENT DOCUMENTS

| | | | |
|---|---|---|---|
| 5,732,389 | 3/1998 | Kroon et al. | 704/223 |
| 5,781,881 | 7/1998 | Stegmann | 704/211 |
| 5,826,226 | 10/1998 | Ozawa | 704/223 |

FOREIGN PATENT DOCUMENTS

| | | |
|---|---|---|
| 0 749 110 | 12/1996 | European Pat. Off. . |
| WO 96/21221 | 7/1996 | WIPO . |

OTHER PUBLICATIONS

Kataoka, A., et al., "LSP and Gain Quantization for CS–ACELP Speech Coder," *NTT Review,* vol. 8, No. 4, Jul. 1996, pp. 30–35.

Kataoka, A., et al., "Improved CELP–Based Coding in a Noisy Environment Using a Trained Sparse Conjugate Codebook," *IEICE Transactions on Information and Systems,* vol. E79–D, No. 2, Feb. 1996, pp. 123–129.

Kataoka, A., et al., "UTU–T 8–kbit/s Standard Speech Code for Personal Communication Services," *IEEE International Conference on Universal Personal Communications,* Nov. 6–10, 1995, pp. 818–822.

Kataoka, A., et al., "A 6.4–kbit/s Variable–Bit–Rate Extension to the G.729 (CS–ACELP Speech Coder," *ICEICE Transactions on Information and Systems,* vol. E80–D, No. 12, Dec. 1997, pp. 1183–1189.

*Primary Examiner*—Susan Wieland

*Attorney, Agent, or Firm*—Pollock, Vande Sande & Amernick

[57] ABSTRACT

An ACELP speech coding method according to ITU-T Recommendation G.729. When coding a random component vector, each of random component vector forming together the random codebook is formed of three or less pulses having a unit amplitude for each 6f a pair of subframes which form together a frame. The positions of the pulses are determined from a plurality of predetermined positions which a pulse can assume in a subframe so that distortion is minimized. The method allows speech coding at a lower bit rate.

34 Claims, 7 Drawing Sheets

FIG.3

| Parameter | Sub-frame | | Frame 80 samples |
|---|---|---|---|
| | 1st | 2nd | |
| LSP | — | — | 1+7+5+5 |
| Pitch delay | 8 | 5 | 13 |
| pitch parity | 1 | — | 1 |
| Algebraic code | 13 | 13 | 26 |
| Sign | 4 | 4 | 8 |
| Gain codebook | 4+3 | 4+3 | 14 |
| Total | — | — | 80 |

FIG.4

| | | |
|---|---|---|
| First stage | 10th order | 7 |
| Second stage | 5th low order | 5 |
| | 5th high order | 5 |
| Selection of predictive coefficients | | 1 |
| Total | | 18 |

FIG.5

EXCITING PULSE STRUCTURE FOR ACELP

| PULSE NO. | TRACK | POSITIONS |
|---|---|---|
| #0 | 0 | 0, 5, 10, 15, 20, 25, 30, 35 |
| #1 | 1 | 1, 6, 11, 16, 21, 26, 31, 36 |
| #2 | 2 | 2, 7, 12, 17, 22, 27, 32, 37 |
| #3 | 3 | 3, 8, 13, 18, 23, 28, 33, 38 |
| | 4 | 4, 9, 14, 19, 24, 29, 34, 39 |

FIG.6

EXCITING PULSE STRUCTURE FOR ACELP

| PULSE NO. | TRACK | POSITIONS |
|---|---|---|
| #0 | 0 | 0, 2, 5, 7, 10, 12, 15, 17, 20, 22, 25, 27, 30, 32, 35, 37 |
| #1 | 1 | 1, 3, 6, 8, 11, 13, 16, 18, 21, 23, 26, 28, 31, 33, 36, 38, |
| | 2 | 4, 9, 14, 19, 24, 29, 34, 39 |

FIG.7

| 9-bit algebraic codebook | | |
|---|---|---|
| sign | positions | |
| ±1 | i0 | 0, 5, 10, 15, 20, 25, 30, 35 |
| | +1 | 2, 7, 12, 17, 22, 27, 32, 37 |
| | i1 | 1, 6, 11, 16, 21, 26, 31, 36 |
| | -1 | 3, 8, 13, 18, 23, 28, 33, 38 |
| no pulse | | 4, 9, 14, 19, 24, 29, 34, 39 |

FIG.8

| 10-bit algebraic codebook | | |
|---|---|---|
| sign | positions | |
| ±1 | i0 | 0, 5, 10, 15, 20, 25, 30, 35 |
| | | 2, 7, 12, 17, 22, 27, 32, 37 |
| ±1 | i1 | 1, 6, 11, 16, 21, 26, 31, 36 |
| | | 3, 8, 13, 18, 23, 28, 33, 38 |
| no pulse | | 4, 9, 14, 19, 24, 29, 34, 39 |

FIG.9

| 11-bit algebraic codebook | | |
|---|---|---|
| sign | positions | |
| ±1 | i0 | 0, 5, 10, 15, 20, 25, 30, 35 |
| | i1 | 2, 7, 12, 17, 22, 27, 32, 37 |
| | i2 | 1, 6, 11, 16, 21, 26, 31, 36<br>3, 8, 13, 18, 23, 28, 33, 38 |
| no pulse | | 4, 9, 14, 19, 24, 29, 34, 39 |

FIG.10

| 11-bit algebraic codebook | | |
|---|---|---|
| sign | positions | |
| ±1 | i0 | 0, 5, 10, 15, 20, 25, 30, (35) |
| | i1 | 2, 7, 12, 17, 22, 27, 32, (37) |
| | i2 | 1, 6, 11, 16, 21, 26, 31, 36<br>3, 8, 13, 18, 23, 28, 33 |
| no pulse | | 4, 9, 14, 19, 24, 29, 34, 38, 39 |

FIG.11

| Para. | Coder A | | Coder B | | Coder C | |
|---|---|---|---|---|---|---|
| LSP | 1+7+5+5 | | 1+7+5+4 | | 1+7+5+4 | |
| Pitch | 8 | 5 | 8 | 5 | 8 | 5 |
| Parity | 1 | | — | | — | |
| Shape Codebook | 8 | 8 | 9 | 9 | 10 | 10 |
| Polarity | 1 | 1 | 1 | 1 | 1 | 1 |
| Gain | 4+3 | 4+3 | 4+3 | 4+3 | 3+3(6) | 3+3(6) |
| Total | 64 | | 64 | | 64 | |

FIG.12

| Para. | Coder D | | Coder E | | Coder F | |
|---|---|---|---|---|---|---|
| LSP | 1+7+5+5 | | 1+7+5+4 | | 1+7+5+4 | |
| Pitch | 8 | 5 | 8 | 5 | 8 | 5 |
| Parity | 1 | | — | | — | |
| Shape Codebook | 4+3 | 4+3 | 4+4 | 4+4 | 4+5 | 4+5 |
| Polarity | 1+1 | 1+1 | 1+1 | 1+1 | 1+1 | 1+1 |
| Gain | 4+3 | 4+3 | 4+3 | 4+3 | 3+3(6) | 3+3(6) |
| Total | 64 | | 64 | | 64 | |

FIG.13

| Para. | Coder G | | Coder H | | Coder I | |
|---|---|---|---|---|---|---|
| LSP | 1+7+5+5 | | 1+7+5+4 | | 1+7+5+4 | |
| Pitch | 8 | 5 | 8 | 5 | 8 | 5 |
| Parity | 1 | | — | | — | |
| Shape Codebook | 4+4 | 4+4 | 4+4 | 4+4 | 3+3+4 | 3+3+4 |
| Polarity | 1 | 1 | 1+1 | 1+1 | 1 | 1 |
| Gain | 4+3 | 4+3 | 4+3 | 4+3 | 3+3(6) | 3+3(6) |
| Total | 64 | | 64 | | 64 | |

FIG.14

| Para. | Coder J | | Coder K | |
|---|---|---|---|---|
| LSP | 1+7+5+3 | | 1+7+5+3 | |
| Pitch | 8 | 5 | 8 | 5 |
| Parity | 1 | | 1 | |
| Shape Codebook | 4+4 | 4+4 | 3+3+4 | 3+3+4 |
| Polarity | 1+1 | 1+1 | 1 | 1 |
| Gain | 4+3 | 4+3 | 3+3(6) | 3+3(6) |
| Total | 64 | | 64 | |

FIG.15

| Para. | Coder L | | Coder M | |
|---|---|---|---|---|
| LSP | 1+7+4+4 | | 1+7+4+4 | |
| Pitch | 8 | 5 | 8 | 5 |
| Parity | 1 | | 1 | |
| Shape Codebook | 4+4 | 4+4 | 3+3+4 | 3+3+4 |
| Polarity | 1+1 | 1+1 | 1 | 1 |
| Gain | 4+3 | 4+3 | 3+3(6) | 3+3(6) |
| Total | 64 | | 64 | |

FIG.16

| | error free | | | error | | switching |
|---|---|---|---|---|---|---|
| | -16 | -26 | -36 | 0.1% | 2T | |
| G.729 | — | 3.76 | — | — | — | — |
| G.723.1 | — | 3.66 | — | — | — | — |
| 24kbit/s ADPCM | 2.72 | 2.65 | 2.65 | 2.40 | 2.27 | 2.89 |
| 6.4kbit/s | 3.65 | 3.69 | 3.61 | 3.23 | 3.26 | 3.70 |

SPEECH CODING METHOD

BACKGROUND OF THE INVENTION

The invention relates to a method of speech coding which is based on the ITU-T recommendation G.729 for 8-kbit/s speech coding scheme CS-ACELP (hereinafter referred to in the specification and claims as "G.729") and which allows speech coding at a lower rate.

Various efficient coding schemes are attempted in the field of digital mobile communications for an efficient utilization of radio waves. Known schemes for speech coding at information rate on the order of 8 kbit/s include CELP (code excited linear prediction), VSELP (vector sum excited linear prediction), CS-ACELP and the like.

For details of these coding schemes, refer to "Code-Excited Linear Prediction (CELP): High Quality Speech at a Very Low Rates" by M. R. Schroeder and B. S. Atal in Proc. ICASSP' 85, 25.1.1, pp 937–940, 1985 (literature 1), "Vector Sum Excited Linear Prediction (VSELP) Speech Coding at 8 kps" by I. A. Gerson and M. A. Jasiuk in Proc. ICASSP' 90, S9.3, pp 461–464, 1990 (literature 2), and "ITU-T 8 kbit/s Standard Speech Codec for Personal Communication Services" by A. Kataoka et al in Int. Conf. On Universal Personal Communication, pp 818–822, 1995 (literature 3). For details of 8 kbit/s International Standard G.729 (CS-ACELP), refer to ITU-T Recommendation: G.729 Coding of speech at 8 kbit/s using conjugate-structure algebraic code excited linear prediction (herein after referred to in the specification and claims as "CS-ACELP") COM 15-152-E, July 1995 (literature 4).

FIG. 1 shows an example of a coder used in such schemes, including an input terminal 11, an adder 12, a subtractor 13, a filter coefficient determination part 14, a filter coefficient quantizer 15, a synthesis filter 16, a perceptual weighting filter 17, a distortion power calculator 18, a code output part 19, an adaptive codebook 21, a random codebook 22, a estimated gain part 23, a gain part 24, a gain estimation part 25, a codebook search part 26, a gain codebook 27 and an LSP codebook 28.

Referring to FIG. 1, an input speech signal waveform is applied to the input terminal 11, and a given number of samples (hereafter referred to as speech waveform vectors) are extracted from the sample train of the waveform every frame of 10 ms to be fed to the filter coefficient determination part 14 where linear prediction coefficients (or LPC coefficients) are calculated. The LPC coefficients are converted into LSP coefficients in the filter coefficient quantizer 15 where they are quantized by reference to the LSP codebook 28. The quantized LSP coefficients have their quantized codes $I_{sp}$ delivered and are also converted back to LPC coefficients to be set up in the synthesis filter 16 as filter coefficients.

The adaptive codebook 21 stores exciting vectors over a plurality of past frames as pitch component vectors which adaptively change. A pitch component vector candidate P is chosen from the plurality of pitch component vectors, and a random component vector candidate C is chosen from a plurality of fixed random component vectors (or random number vectors) contained in the random codebook 22. Gains $g_P$, $g_N$ chosen from the gain codebook 27 and forming a gain vector candidate $g=(g_P, g_N)$ are applied to the candidates P, C in multipliers 24P, 24N, respectively, of the gain part 24, and the resulting products are added together in the adder 12 to be fed to the synthesis filter 16 as exciting vectors, thus synthesizing a speech. The gain estimation part 25 predicts from past random component vectors an approximate gain, which is then set up in the estimated gain part 23.

A synthesized speech is subtracted from the input speech waveform vector X, and a resulting error vector is perceptually weighted in the perceptual weighting filter 17 to be fed subsequently to the distortion power calculator 18. The distortion power calculator 18 calculates the power of a perceptually weighted error (or distortion), and the codebook search part 26 is effective to select respective candidate vectors from the adaptive codebook 21, the random codebook 22 and the gain codebook 27 so that the power in the distortion is minimized. Code output part 19 delivers indices $I_P$, $I_N$, $I_G$, representing these selected vectors, together with code $I_{sp}$ which represents the quantized LSP coefficients as coded outputs.

FIG. 2 shows an example of a decoder corresponding to the coder shown in FIG. 1, including an input terminal 31, an adder 32, a filter coefficient decoder 33, a synthesis filter 34, an adaptive codebook 35, a random codebook 36, a estimated gain part 37, a gain part 38, a gain estimation part 39, and a gain codebook 41. In the arrangement of FIG. 2, the received code $I_{sp}$ is fed to the filter coefficient decoder 33 where LSP coefficients are decoded and then converted into LPC coefficients, which are in turn fed to the synthesis filter 34 to be used as filter coefficients therein. The received code $I_G$ is decoded into gain vector $(g_P, g_N)$ in the gain codebook 41 for use as gains $g_P$, $g_N$ in the multipliers 38P, 38N of the gain part 38.

On the other hand, pitch component vector P and random component vector C are read out from the adaptive codebook 35 and the random codebook 36, respectively, in a manner corresponding to the received codes $I_P$ and $I_N$. The pitch component vector P is multiplied by the gain $g_P$ in the gain part 38 while the random component vector C is initially multiplied by the estimated gain from the gain estimation part 39 in the estimated gain part 37 to be adaptively gain adjusted and is then multiplied by the gain $g_N$ in the gain part 38. The gain controlled pitch component vector and random component vector from the gain part 38 are synthesized in the adder 32 to be fed to the synthesis filter 34 as exciting vectors, whereby a decoded speech is delivered.

FIG. 3 shows a bit allocation for coding individual parameters used in G.729. In G.729, a frame length is equal to 10 ms, using 80 bits per frame. Of these, 18 bits are allocated to coding LSP coefficients. The coding of LSP coefficients takes place by way of a vector quantization in two stages as illustrated in FIG. 4. In the first stage vector quantization, a 10-th order vector quantization is effected using a first stage LSP codebook having 128 candidates (7 bits). In the second stage, a 10-th bit vector quantization is effected using a pair of LSP codebooks, a higher order and a lower order one, each having 32 candidates (5 bits) to enable a 5-th order vector quantization. One bit is allocated for selection of prediction coefficients.

For coding a pitch component vector using the adaptive codebook 21, the frame is divided into a first 5 ms subframe and a second 5 ms subframe. 8 bits and one parity bit are allocated to the first subframe while 5 bits are allocated to the second subframe. For coding a random component vector using the random codebook 22, 17 bits, inclusive of 4 bits for the polarities of four pulses, are allocated to each subframe.

FIG. 5 shows predetermined positions which the four pulses can assume when a random exciting pulse structure to be used in coding the random component vector with the random codebook according to G.729 is realized by using four pulses in each subframe. Specifically, positions from No. 0 to No. 39 are defined in the 40 ms subframe at a spacing of 1 ms, for example, and such 40 positions are allocated to pulses #0 to #3 as shown in the chart of FIG. 5 which conforms to G.729. As will be evident from the chart, eight positions are available for each of the pulses #0, #1 and #2 in tracks 0, 1 and 2, and thus a position can be specified by three bits. For pulse #3, sixteen positions are available in two tracks 3 and 4. Thus the position can be specified by four bits. Hence, information representing the positions of the four pulses in each subframe can be given by 13 bits. In addition to the 13 bits, the sign (polarity) of each of the four pulses is given by one bit, thus using a total of 17 bits for each entire subframe.

For coding a gain vector with the gain codebook 27, 7 bits are allocated to each subframe as indicated in FIG. 3, thus using a total of 14 bits.

It is to be noted that when performing a communication with Codec according to the ITU International Standard G.729, it is possible that a sufficient transmission capacity may not be secured depending on the condition of a transmission path, presenting a problem that the communication may be disabled. While it may be contemplated to achieve the communication by using a coding scheme which requires a less transmission capacity, this presents another problem that an entirely distinct coder and decoder combination is necessary. Accordingly, it is desirable in such instance to reduce the bit rate of the signal without a significant degradation in the speech quality while allowing a code structure similar to that of the International Standard G.729 to be retained. However, it has been unknown how it is possible to reduce the bit allocation to a particular part of the code structure effectively without accompanying a degradation in the speech quality.

SUMMARY OF THE INVENTION

It is an object of the invention to provide a speech coding method which permits a bit rate to be reduced without a significant degradation in the speech quality while conforming to the speech coding according to the International Standard G.729.

In accordance with the invention, there is provided a speech coding method according to ACELP in which an LSP coefficient, a pitch component vector, a random component vector and gain vectors which are applied to the pitch component vector and the random component vector are coded using an LSP codebook, an adaptive codebook, a random codebook and a gain codebook, respectively, so that a distortion relative to an input speech waveform vector is minimized for each frame, comprising the step of coding the random component vector such that each of random component vectors forming together the random codebook is formed of three or less pulses having a unit amplitude for each of a pair of subframes which form together a frame, the position of the pulses being determined from a plurality of predetermined positions which a pulse can assume in a subframe so that a distortion in a synthesized speech is minimized.

BRIEF DESCRIPTION OF THE DRAWINGS

FIG. 3 is a chart showing a bit allocation for coding parameters according to G.729 in each frame;

FIG. 4 is a chart showing a detail of a bit allocation for coding LSP coefficients shown in the chart of FIG. 3;

FIG. 5 is a chart showing a specific example of a random codebook shown in the chart of FIG. 3;

FIG. 6 is a chart showing an example of an 11-bit random codebook according to the invention;

FIG. 7 is a chart showing an example of a 9-bit random codebook;

FIG. 8 is a chart showing an example of a 10-bit random codebook;

FIG. 9 is a chart showing another example of an 11-bit random codebook;

FIG. 10 is a chart showing a further example of an 11-bit random codebook;

FIG. 11 is a chart showing a bit allocation for coding individual parameters when a single random codebook is employed;

FIG. 12 is a chart showing a bit allocation for coding individual parameters when a conjugate structure random codebook is employed;

FIG. 13 is a chart showing a bit allocation for coding individual parameters when a 9-bit random codebook is employed;

FIG. 14 is a chart showing a bit allocation for coding individual parameters when higher-order bits in the second stage of an LSP codebook are further reduced;

FIG. 15 is a chart showing a bit allocation for coding individual parameters when lower-order bits in the LSP codebook are further reduced; and FIG. 16 is a chart showing a comparison of performance according to a subjective evaluation between the speech coding method of the invention and another coding method.

DETAILED DESCRIPTION OF THE PREFERRED EMBODIMENTS

Figure 1:
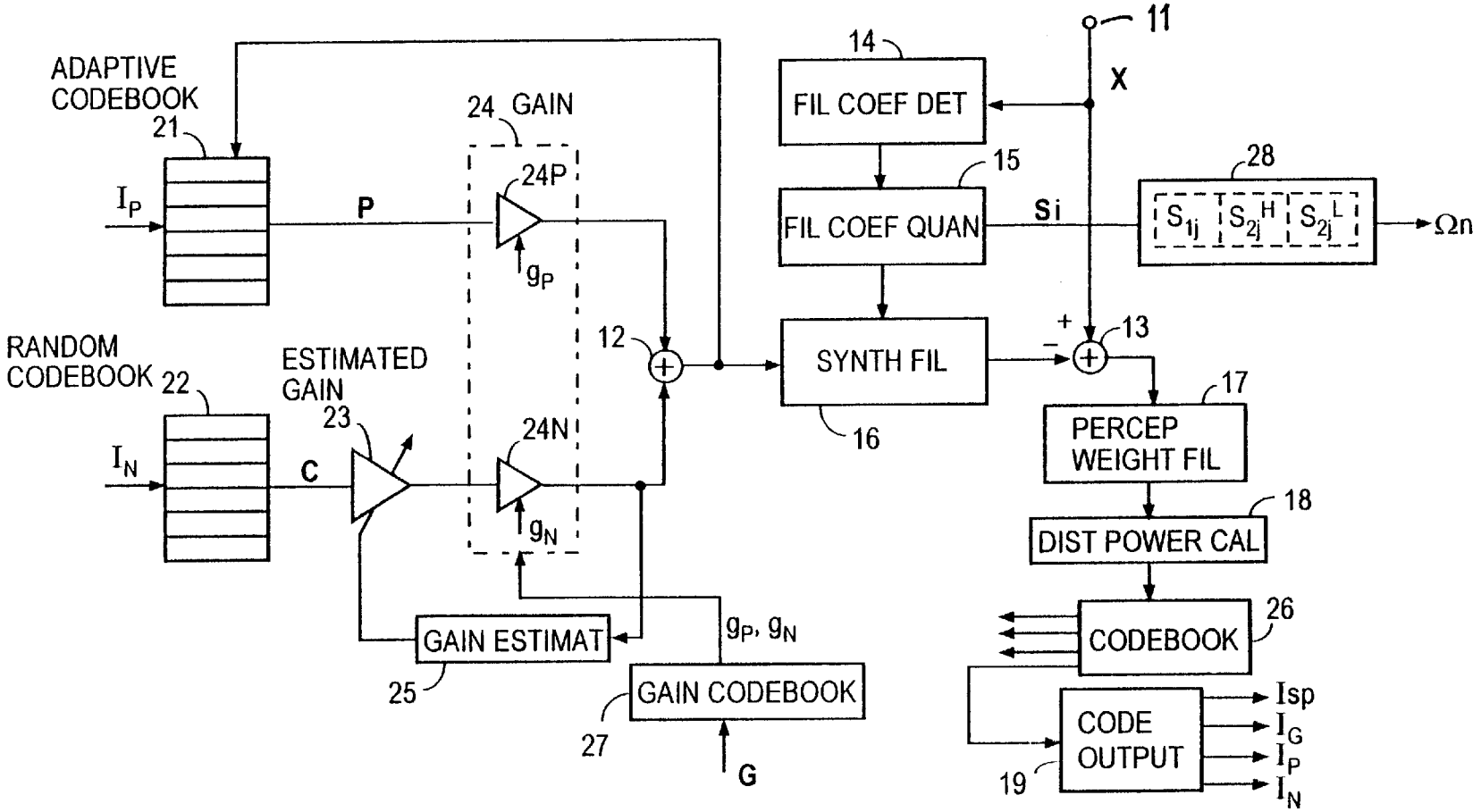
FIG. 1 is a block diagram of a CELP coder according to the International Standard G.729 on which the invention is premised.
Figure 2:
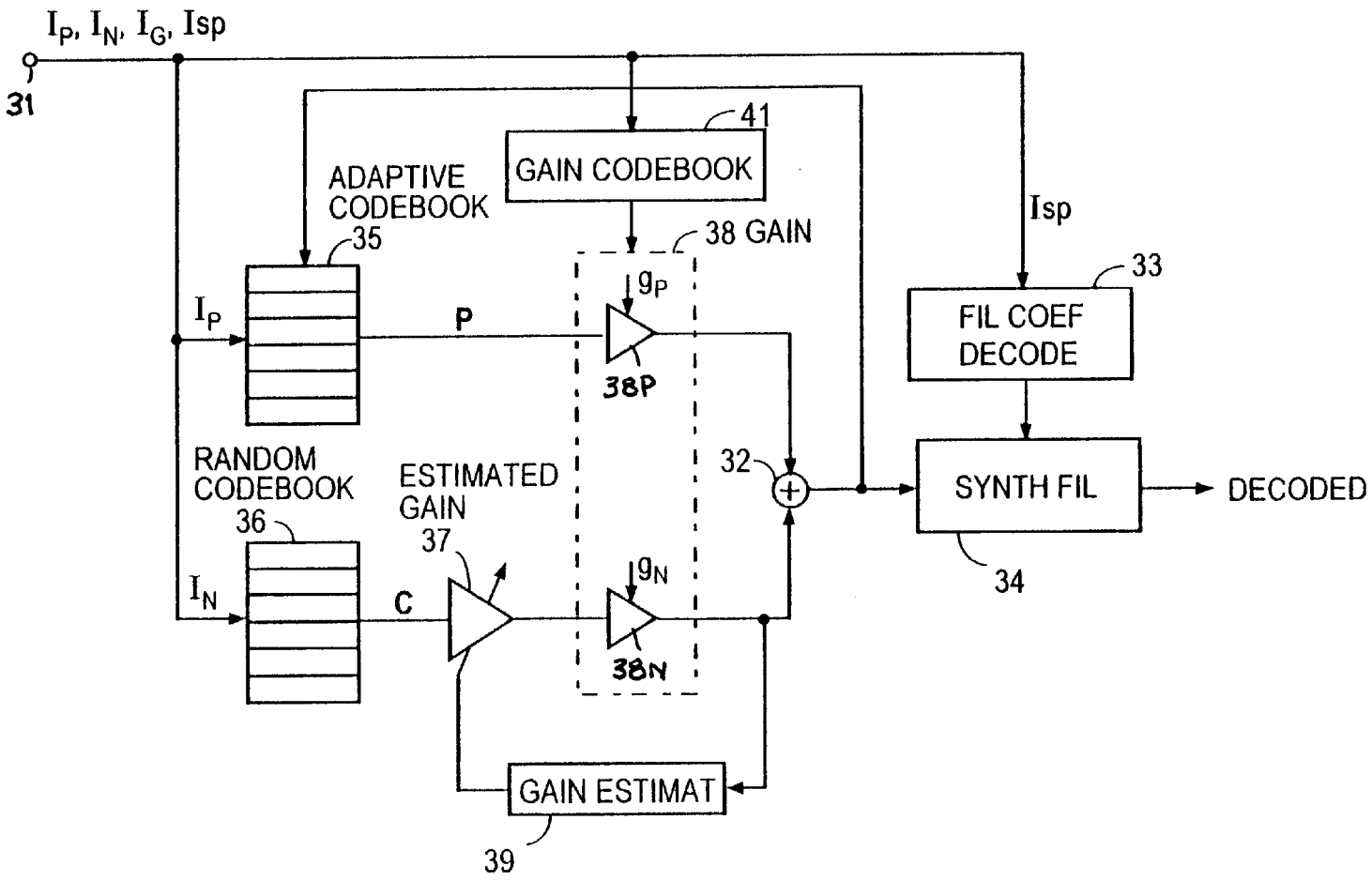
FIG. 2 is a block diagram of a decoder, corresponding to the coder shown in FIG. 1.

It is initially to be noted that the speech coding method of the invention premises the use of a coder as shown in FIG. 1 which conforms to the standard G.729. In the International Standard G.729, the coding system as shown in FIG. 1 employs a frame length of 10 ms and 80 bits per frame for purpose of coding. When the bit rate is changed to 6.4 kbit/s while maintaining the same frame size, the number of bits used for coding must be reduced to 64 bits per frame or must be reduced by 16 bits per frame. It is then necessary to examine if an effective reduction can be achieved while maintaining any resulting degradation in the speech quality at an unnoticeable level by determining to which parameter the bit allocation may be reduced in the code structure for each frame as shown in FIG. 3 which is used in G.729, thus realizing an optimum code structure at 6.4 kbit/s. However, because the 6.4 kbit/s coding operates as an extension of 8 kbit/s coding (G.729), a smooth switching between the both must be assured. In other words, it is required that a good quality be achieved at 6.4 kbit/s and at the same time, it is also necessary to prevent a clearly extraneous sound from being sensed upon switching to 8 kbit/s.

EXAMPLE 1

Reduction of Bits Used in Coding Pitch Component Vector

A pitch component vector has a great influence upon the decoded speech quality and accordingly no bit reduction is made to 13-bit pitch information in order to realize the high quality with the 6.4 kbit/s coding. In G.729, the most significant 6 bits in the 8-bit pitch information in the first subframe are protected by one parity bit. Thus, if a bit error occurs in the course of a transmission path, the error can be detected by the parity bit, and in such instance, the pitch period of the previous subframe is substituted for the pitch period of the current subframe. Since the parity bit is wasteful when no error is present, the parity bit is deleted.

EXAMPLE 2

Reduction of Bits Used in Coding LSP Coefficients

G. 729 employs an 18-bit LSP quantizer. The LSP quantizer comprises a two stage LSP codebook which employs a 4-th order interframe prediction (literature 4). A quantized LSP coefficient Ωn of an n-th frame is given as follows:

$$\Omega_n = F_0 S_n + \sum_{i=1}^{4} F_i S_{n-1}, \sum_{i=0}^{4} F_i = I \tag{1}$$

where $F_i$ represents a diagonal matrix of prediction coefficients for interframe prediction, I unit matrix, and $S_n$ a second stage vector quantization output using the LSP codebook during n-th frame (or current frame).

A quantization vector $S_n$ which is output from the LSP codebook is represented as a sum of a pair of codebooks as indicated below:

$$\begin{aligned} S_n &= S_{1j} + S_{2j}^{L} \quad \text{for } j = 0, \ldots, 4 \\ &= S_{1j} + S_{2j}^{H} \quad \text{for } j = 5, \ldots, 9 \end{aligned} \tag{2}$$

where $S_{1j}$ is an output (7 bits) from the first stage LSP codebook, $S_{2j}^{L}$ a low-order output (5 bits) from the second stage as indicated in the chart of FIG. 3, and $S_2^{H}$ a higher order output (5 bits) from the second stage.

A search is made for a combination of Ωn and an input LSP coefficient $\Omega_{in}$ for which a distortion of $d_{sp}$, which is defined as indicated below, $$d_{sp}=(\Omega_{in}-\Omega_n)^T W_n(\Omega_{in}-\Omega_n) \tag{3}$$

is minimized. In this equation, $W_n$ represents a weighting coefficient obtained from the input LSP coefficient. Of these bits, the LSP codebook $S_{1j}$ in the first stage and the prediction coefficient $F_i$ have a great influence upon the performance. The lower the order of the LSP coefficient, the greater the impact upon the speech quality.

To achieve the 6.4 kbit/s coding, a bit reduction is made from the second stage LSP codebook which is considered to have relatively less contribution to the performance. Since the second stage LSP codebook is used to quantize a component which remains when an output from the first stage LSP codebook is subtracted from the input LSP, the second stage LSP codebook assumes a random value. The LSP coefficient assumes a value in a range from 0 to π.

Case (1): The bits in the second stage higher order LSP codebook $S_{2j}^{H}$ is reduced from 5 bits to 4 bits, thus forming a codebook using 16 codes having an index number from 0 to 15. A 4-bit LSP codebook which is suitable for use in the 6.4 kbit/s coding may be chosen by selecting appropriate codes from a 5-bit LSP codebook which is destined for use in the 8 kbit/s. Alternatively, codes having a sequential index number from 0 to 15 may be chosen from codes in the 5-bit LSP codebook which have index numbers from 0 to 31 in a simple manner.

It is to be understood that in the 8 kbit/s coding (G.729), the second stage LSP codebook is designed to provide an optimum result when 5 bits are used. It is then contemplated to provide a re-learning of the second stage codebook so that an optimum result is obtained when 4 bits are used. In this instance, it is necessary to provide a second stage higher order LSP codebook for use in the 6.4 kbit coding, in addition to the second stage higher order codebook for use in the 8 kbit/s coding. An augmentation required for the memory to provide the new codebook is equal to 80 words (5-th order vector×16=80).

Case (2): Similarly, the bits in the second stage higher order LSP codebook may be reduced by two bits (thus changing from a 5-bit codebook to a 3-bit codebook). In a similar manner as mentioned above, part of the original codebook may be used. Alternatively, a second stage higher order LSP codebook having 3 bits and which provides an optimum result may be prepared by re-learning.

Case (3): 1 bit may be reduced from the second stage higher order LSP codebook $S_{2j}^{H}$ and also 1 bit may be reduced from the lower order LSP codebook $S_{2j}^{L}$ (thus changing each from a 5-bit to 4-bit codebook).

In a similar manner as mentioned above in connection with Case (2), it is possible to use part of the original LSP codebook, or alternatively, a higher order LSP codebook and a lower order LSP codebook each having 4 bits may be provided which provides an optimum result by re-learning. Such choices may be used in combination. For example, the lower order codebook is subject to re-learning while the higher order codebook comprises a part of the original codebook.

EXAMPLE 3

Reduction of a Bit or Bits from the Random Codebook

As shown in the chart of FIG. 5 in G.729, the random component vector of each subframe is represented by 4 vectors and there are provided 8, 8, 8 and 16 positions which the 4 pulses #0 to #3 can assume. These positions are indicated by using 13 bits, and one bit is used for the polarity of each pulse. In accordance with the invention, to provide a method of reducing a bit or bits most effectively while suppressing a degradation in the quality of decoded speech to an unnoticeable level, several cases will be described below for reducing a bit or bits which are allocated to coding random component vectors.

Case (1): As shown in the chart of FIG. 6, a random component vector is represented in terms of two pulses #0 and #1 for each subframe. Sixteen positions are available for the pulse #0 and can be represented by 4 bits. 32 positions are available for the pulse #1 and can be represented by 5 bits. One polarity bit is allocated to each of the pulses #0 and #1. In this manner, a total of (4+5+2=) 11 bits are allocated to each subframe. This allows the number of bits which are allocated to coding random component vector in one frame to be reduced from 34 bits for the arrangement of G.729 to 22 bits.

A codebook for random component vectors according to the pulse structure shown in FIG. 6 includes $2^{11}$ vectors, and a search for the pulse position is made in a manner such that a distortion of a speech which is provided by the synthesis filter 16 by synthesizing random component vectors C as exciting vectors relative to an input speech waveform vector (target vector) X is minimized. Representing the impulse response matrix of the synthesis filter 16 by H, the distortion dr is given as follows:

$$dr = |X|^2 - \frac{(X^T H C_k)^2}{\|HC_k\|^2} = \frac{(d^T C_k)^2}{C_k^T \Phi C_k} \tag{4}$$

where d represents a correlation vector between $X^T$ and H or $d=H^T X$ and Φ a correlation matrix with H or $\Phi=H^T H$. d and $\Phi$ are previously calculated, and a calculation is made of $dr=(d^TC_k)^2/C_k^T\Phi C_k$ for each vector candidate $C_k$ in order to select an exciting vector (random component vector) $C_k$ from the random codebook 22 which minimizes dr. Exciting vectors $C_k$ comprise pulses having amplitudes of 0 or ±1. Accordingly, the calculation according to the equation (4) can take place by a multiplication of a sign and an addition, in the similar manner as indicated for G.729 in the literature (4). A shape codebook of such exciting vectors is called an algebraic codebook.

During the search for a pulse position, an optimum solution can be found by calculating $d^TC_k$ for all combinations of track 0 and tracks 1, 2. However, to reduce the amount of calculation, it is also possible to employ a simplification such as initially determining the position of only the track 0.

Case (2): A 9-bit random codebook shown in FIG. 7 is used. As shown in FIG. 7, the exciting pulse structure comprises a pair of pulses in each subframe, which have opposite polarities, providing 16 available positions for each pulse. Conversely, there are defined eight unavailable positions. Accordingly, each of the two pulse positions can be represented in terms of four bits, and there is provided one bit which serves reversing the polarities of the two pulses simultaneously. In this manner, 9 bits are allocated to each subframe. Thus, by using a 9-bit random codebook, the number of bits can be reduced by as many as 8 bits per subframe or 16 bits per frame. The 9-bit random codebook comprises an 8-bit shape codebook together with one polarity bit. In this instance, it is possible to use a random signal directly as an exciting vector for the shape codebook or to produce an exciting vector by learning process.

Alternatively, the random codebook may be divided into a pair of sub-codebooks. Thus a conjugate-structure codebook in which an exciting vector is represented as a sum of a pair of sub-vectors may be used. By way of example, a combination of a 3-bit shape codebook together with one sign bit or a combination of a 4-bit shape codebook together with one sign bit may be used though the number of pulse portions in the 3-bit shape codebook should be made to 8. It is also possible to represent the exciting vector by a pulse having an amplitude of 1 in the similar manner as in G.729.

Case (3): A 10-bit random codebook as shown in FIG. 8 is used.

The 10-bit random codebook as shown in FIG. 8 comprises random component vectors where each subframe comprises a pair of pulses, in the similar manner as described above in connection with FIG. 7. However, in the instance of FIG. 8, one polarity bit is associated with each pulse so that the polarity of each of the pair of pulses can be independently selected. By using this random codebook, the number of bits can be reduced by as many as 7 bits per subframe, or 14 bits per frame. The 10-bit random codebook comprises a 9-bit shape codebook together with one polarity bit associated with each pulse. In this instance, a random signal may be directly used as an exciting vector for the shape codebook or to produce an exciting vector by a learning process.

Alternatively, a conjugate-structure codebook may be used in which an exciting vector is represented as a sum of a pair of sub-vectors by dividing the random codebook into a pair of sub-codebooks. By way of example, it is possible to use a combination of a 4-bit shape codebook together with one sign bit and a of 4-bit shape codebook together with one sign bit. It is also possible to represent an exciting vector by a pulse having an amplitude of 1 in the similar manner as in G.729.

Case (4): An 11-bit random codebook as shown in FIG. 9 is used.

In the example shown in FIG. 9, a subframe is constructed with three pulses. Eight available positions are given to each of the pulses #1 and #0 while sixteen available positions are given to the pulse #2. Accordingly, a total of (3+3+4=) 10 bits are allocated to define the position of the three pulses. The relative polarity of the three pulses is predetermined. For example, pulses i0 and i1 are positive while pulse i2 is negative. There is also provided another bit which controls a simultaneous reversal of the polarity of these three pulses. By using the 11-bit random codebook, the number of bits can be reduced by as many as 6 bits per subframe or 12 bits per frame. The 11-bit random codebook comprises a 10-bit shape codebook together with one sign bit. In this instance, it is possible to use a random signal directly as an exciting vector for the shape codebook or to produce an exciting vector by a learning process.

Alternatively, a conjugate-structure codebook in which an exciting vector is represented by a sum of a pair of sub-vectors may be used by dividing a random codebook into a pair of sub-codebooks. By way of example, a combination of a 5-bit shape codebook together with one sign bit or a combination of a 4-bit codebook together with one sign bit may be used. It is also possible to represent an exciting vector by a pulse having an amplitude of 1 in the similar manner as in G.729.

The structure shown in FIG. 9 is not always limited to its use for three pulses, but may also be used selectively for two pulses or three pulses. FIG. 10 shows such a structure. Specifically, no pulse is placed at position 38, and when i2 indicates 38, only pulses i0 and i1 are used. When the pulse i1 indicates 37, only the pulses i0 and i2 are used. In this instance, 38 is not used with a pulse i2. In addition, when a pulse i0 indicates 35, only the pulses i1 and i2 are used. In this instance, the pulse i1 is not placed at 37. By conducting a search according to this rule, an optimum one can be searched among combinations of two pulses or three pulses.

EXAMPLE 4

Example of Search among Random Codebook

In order to improve the quality of the 6.4 kbit/s coding, a conditional orthogonalization is introduced into the search of random exciting vector. During the CELP coding, when a search of the random codebook is made, a k-th random component vector $C_k$ from the random codebook 12 is applied as an exciting vector to the synthesis filter 16 (thus, choosing gains $g_P=0$, $g_N=1$), and an exciting component vectors) $C_k$ is selected which minimizes the distortion of an output synthesized speech $HC_k$ relative to the input speech vector (target vector) X, as given by the equation (4).

When a random component vector is used for synthesis with a pitch component vector to code an input speech, it is known that the quality of synthesized speech can be enhanced by orthogonalizing an output from the synthesis filter 16 or by removing a component contained in the random component vector and which is parallel to the pitch component vector subsequent to the determination of the pitch component vector and during a search of an optimum random component vector from the random codebook in consideration of the determined pitch component vector.

A random exciting vector $H\hat{C}_k$ which is orthogonalized with respect to the pitch component vector P is given as follows:

$$H\hat{}C_k = HC_k - \frac{(HC_k)^T HP}{\|HP\|^2} HP \tag{5}$$

When an optimum gain for the exciting vector is determined, the distortion dr between the target vector X and the synthesized speech is represented as follows:

$$dr = |X|^2 - \frac{(X^T H\hat{}C_k)^2}{\|H\hat{}C_k\|} \tag{6}$$

Accordingly, to minimize the distortion, a search is made for a random component vector $C_k$ which maximizes the second term on the right side of the equation (6):

$$\frac{(X^T H\hat{}C_k)^2}{\|H\hat{}C_k\|} \tag{7}$$

The numerator of the equation (6) can be modified as follows:

$$X^T H\hat{}C_k = \hat{X}^T HC_k, \text{ where } \hat{X} = \left\{X - \frac{X^T HP}{\|HP\|^2} HP\right\} \tag{8}$$

This is equivalent to the target vector X as orthogonalized with respect to the excitation output HP by the pitch component vector P. The modification reduces the calculation to the calculation of the numerator in the equation (4).

On the other hand, the denominator of the equation (7) can be written as follows:

$$\|H\hat{}C_k\|^2 = \|HC_k\|^2 - \frac{(HP^T HC_k)^2}{\|HP\|^2} \tag{9}$$

where $1/\|HC_k\|^2$(=A) is a constant, and by putting $(HP)^T H$= E, the equation (6) is reduced as follows:

$$\|H\hat{}C_k\|^2 = \|HC_k\|^2 - A(E^T C_k)^2 \tag{10}$$

$E^T C_k$ can be obtained from E by adding values at points corresponding to the pulse positions for the number of pulses. An augmentation in the amount of calculation which is caused by the orthogonalization remains to be only the component of $A(E^T C_k)^2$, which is very slight.

When the random exciting vector has a high degree of freedom, the orthogonalization improves the speech quality. However, when an algebraic codebook as shown in FIGS. 6 to 10 is used as the random codebook, there is a greater limitation on the pulse position in the random exciting vector even though the amount of calculation required for the search is reduced, and hence the quality is not always improved. For this reason, the search according to the equation (7) is effected only when an orthogonalized search is desirable, but otherwise the search according to equation (4) is effected. An optimum gain $g_{P_opt}$ for the pitch is used as the condition to effect such a switching. An optimum pitch gain is described as follows:

$$g_{P_opt} = \frac{X^T HP}{\|HP\|^2} \tag{11}$$

When the pitch gain is high, the pitch component has a greater contribution, and accordingly, the orthogonalization with respect to the pitch component vector is effective. Accordingly, only when the following condition:

$$g_{P-opt} \geqq g_{th} \tag{12}$$

is satisfied, the orthogonalized search is effected. The threshold $g_{th}$ may have a value such as 0.5, for example. Alternatively, a estimated gain for the pitch as given below:

$$Pr = 20 \log \{\|X\|^2 / \|X - HP\|^2\} \tag{13}$$

may be used as the switching condition. In this equation, X represents an input speech waveform vector and HP a pitch waveform vector. As mentioned previously, the orthogonalized search is effected only when the estimated gain for the pitch is high.

EXAMPLE 5

Reduction of Bit or Bits from Gain Codebook

In G. 729, a gain codebook having 7 bits per subframe is used to quantize the pitch gain and the gain of the random exciting vector. Respective gains $g_P$, $g_N$ are each represented by a sum of a pair of sub-codebooks. When preparing the present codebook, a learning process is incorporated in consideration of a transmission path error. By incorporating the learning which takes a transmission error into consideration, the influence of the error can be reduced if an error in the bits of a gain code occurs in the course of transmission path. This can be achieved at a sacrifice of a degradation in the quality of reproduced speech under an error-free condition as compared with the quality of speech reproduced using a codebook which is obtained without consideration of such a transmission error.

In the embodiment described here, a 6-bit gain codebook is produced by reducing a bit or bits from the gain codebook employed in the G.729. Since the gain codebook is reduced one bit, a reproduced speech signal would tend to be degraded in quality. In this embodiment according to the present invention, degradation in the reproduced speech quality can be suppressed as compared with the use of 7-bit codebook, by preparing the gain codebook with a bit error rate which is less than the bit error rate (=0.5%) employed in the preparation of the gain codebook according to the G.729. The new codebook can also be formed as a single codebook for vector quantization in 6 bits. Alternatively, it may be divided into a pair of 3-bit codebooks as conjugate codebook in a similar manner as in G. 729. When the pair of codebooks are used, an augmentation required for the memory capacity by the use of the new gain codebook remains to be as small as 32 words (8×2×2=32).

EXAMPLE 6

Example of 6.4 kbit/s Coder

As a result of above considerations, a coder is designed as described below.

Case (1): A bit or bits are reduced only from the random codebook.

By reducing a bit or bits only from the random codebook, a 9-bit random codebook is used. Shown in the column for the Coder A of FIG. 11 is an example of bit allocation for coding individual parameters when a single 9-bit (8 bits for shape and one bit for polarity) random codebook is used. Shown in the column for Coder D of FIG. 12 is an example of bit allocation for coding individual parameters when a 9-bit ((4+3) bits for shape and (1+1) bits for polarity) conjugate-structure random codebook is used. Also shown in the column for Coder G of FIG. 13 is an example of bit allocation when a 9-bit (two pulses; four bits for each pulse position and one polarity bit for two pulses) random codebook is used.

Case (2): Parity bits are reduced, and the higher bits in the second stage of LSP codebook is reduced by one bit to 4 bits, employing a 10-bit random codebook.

Shown in the column for Coder B of FIG. 11 is an example of bit allocation when a 10-bit (9 bits for shape and one polarity bit) single random codebook is used. Shown in the column for Coder E of FIG. 12 is an example of a bit allocation when a 10-bit ((4+4) bits for shape and (1+1) bits for polarity) conjugate-structure random codebook is used. Shown in the column for Coder H of FIG. 13 is an example of bit allocation when a 10-bit (two pulses; four bits for each pulse position and one bit each for the polarity of each pulse) random codebook is used.

Case (3): Parity bits are reduced and higher order bits in the second stage of LSP codebook is reduced by one bit to 4 bits, and one bit is reduced from the gain codebook to 6 bits, using a 11-bit random codebook.

Shown in the column for Coder C of FIG. 11 is an example of bit allocation when an 11-bit ( 10 bits for shape and one polarity bit) single random codebook is used. Shown in the column for the Coder F of FIG. 12 is an example of bit allocation when an 11-bit ((4+5) bits for shape and (1+1) bits for the polarity) conjugate-structure random codebook is used. Shown in the column for the Coder I of FIG. 13 is an example of a bit allocation when a 11-bit (three pulses; (3+3+4) bits for respective pulse positions and one polarity bits for three pulses) random codebook is used. In this instance, the 2–3 pulse type random codebook may be used as the 11-bit random codebook mentioned above. The gain codebook may comprise either a 6-bit collective codebook or a (3+3) conjugate-structure codebook.

Case (4): Instead of reducing the parity bits in the Cases (2) and (3), a further bit may be reduced from the higher order bits from the second stage of LSP codebook, thus reducing a total of two bits (Coder J, K of FIG. 14).

Case (5): Instead of reducing the parity bits in the Cases (2) and (3), one bit may be reduced from the lower order bits from the second stage of LSP codebook, thus reducing to the total of 4 bits (Coder L, M of FIG. 15).

Case (6): In the Cases (1) to (5), a conventional search for the random exciting vector [a search according to the equation (4)] or an orthogonalized search with respect to the pitch waveform [a search according to the equation (7)] may be used. Alternatively, a switching between the both may be performed depending on a certain condition.

Evaluation Experiment

Using a subjective evaluation, the performance of a coding method has been evaluated in which the bit allocation for the coder corresponds to the Case (3) using a 11-bit algebraic random codebook of 2–3 pulse type with a switching of the searches depending on the optimum gain for the pitch. The evaluation was made at five levels from level 1 to level 5. There were 24 listeners.

For purpose of comparison, 24 kbit/s ADPCM, 8 kbit/s G.729 and 6.3 kbit/s G. 723.1 are used as different coding methods. G. 723.1 uses a long frame length of 30 ms and performs a coding through a look-ahead of 7.5 ms. The present 6.4 kbit/s coding method uses a frame length of 10 ms and a look-ahead of 5 ms. Results are shown in FIG. 16.

It will be seen that the method according to the invention achieves a quality which is equivalent to G.723. 1 as referenced to an input speech level (−26 dB) even though the number of pulses representing a random component vector is reduced to three or less and a bit allocation for coding is greatly reduced. An equivalent quality is also achieved when there is a level variation (−16 dB, −36 dB). As judged from a result for a random bit error of 0.1%, it is seen that no significant degradation is recognized if the pitch parity is omitted. From a result between between 6.4 kbit/s and 8 kbit/s every 10 ms interval, it is seen that a degradation caused by the switching is reduced.

Effects of the Invention

As described, in accordance with the invention, by reducing the number of pulses which represent a first and a second sub-vector of each of random component vectors, comprising a random codebook, to three or less, it is possible to reduce the number of bits allocated for coding without causing a significant degradation in the speech quality. By combining the method of invention with a reduction of allocated bits through a modification of coding module and table for other parameters of G.729 (8 kbit/s), the 6.4 kbit/s coding can be realized, allowing either bit rate to be selected depending on the capacity of the channel or applications. In this manner, a communication is enabled, even when a sufficient transmission capacity is not secured. In addition, by realizing a coding while using a module which is common with G.729, the bit rate can be made selectable as required while suppressing an augmentation of the memory capacity or the like.

What is claimed is:

1. A speech coding method according to conjugate-structure algebraic code excited linear prediction, hereinafter referred to as CS-ACELP, in which an LSP coefficient, a pitch component vector, a random component vector, and gain vectors which are applied to the pitch component vector and the random component vector are coded using an LSP codebook, an adaptive codebook, a random codebook and a gain codebook, respectively, such that a distortion relative to an input speech waveform vector is minimized for each frame;

comprising the step of coding the random component vector such that each of random component vectors forming together the random codebook is formed of three or less pulses having a unit amplitude for each of a pair of subframes which form together a frame, the positions of the pulses being determined from a plurality of predetermined positions which a pulse can assume in a subframe so that a distortion in a synthesized speech is minimized;

wherein each random component vector in the random codebook comprises a pair of sub-vectors, each sub-vector comprising a pair of pulses having a unit amplitude.

2. A speech coding method according to conjugate-structure algebraic code excited linear prediction, hereinafter referred to as CS-ACELP, in which an LSP coefficient, a pitch component vector, a random component vector, and gain vectors which are applied to the pitch component vector and the random component vector are coded using an LSP codebook, an adaptive codebook, a random codebook and a gain codebook, respectively, such that a distortion relative to an input speech waveform vector is minimized for each frame;

comprising the step of coding the random component vector such that each of random component vectors forming together the random codebook is formed of three or less pulses having a unit amplitude for each of a pair of subframes which form together a frame, the positions of the pulses being determined from a plurality of predetermined positions which a pulse can assume in a subframe so that a distortion in a synthesized speech is minimized;

wherein each random component vector in the random codebook comprises a pair of sub-vectors, each sub-vector comprising three pulses having a unit amplitude.

3. A speech coding method according to conjugate-structure algebraic code excited linear prediction, hereinafter referred to as CS-ACELP, in which an LSP coefficient, a pitch component vector, a random component vector, and gain vectors which are applied to the pitch component vector and the random component vector are coded using an LSP codebook, an adaptive codebook, a random codebook and a gain codebook, respectively, such that a distortion relative to an input speech waveform vector is minimized for each frame;

comprising the step of coding the random component vector such that each of random component vectors forming together the random codebook is formed of three or less pulses having a unit amplitude for each of a pair of subframes which from together a frame, the positions of the pulses being determined from a plurality of predetermined positions which a pulse can assume in a subframe so that a distortion in a synthesized speech is minimized;

wherein each random component vector in the random codebook comprises two sub-vectors, which may be selectively defined by two or three pulses each having a unit amplitude.

4. A speech coding method according to conjugate-structure algebraic code excited linear prediction, hereinafter referred to as CS-ACELP, in which an LSP coefficient, a pitch component vector, a random component vector, and gain vectors which are applied to the pitch component vector and the random component vector are coded using an LSP codebook, an adaptive codebook, a random codebook and a gain codebook, respectively, such that a distortion relative to an input speech waveform vector is minimized for each frame;

comprising the step of coding the random component vector such that each of random component vectors forming together the random codebook is formed of three or less pulses having a unit amplitude for each of a pair of subframes which form together a frame, the positions of the pulses being determined from a plurality of predetermined positions which a pulse can assume in a subframe so that a distortion in a synthesized speech is minimized;

wherein a search for the random component vector using the random codebook takes place by a search in which the random component vector is orthogonalized with respect to the pitch component vector when an optimum pitch gain has a value which exceeds a predetermined value, and takes place by a search without orthogonalization when the pitch gain does not exceed the predetermined value.

5. A speech coding method according to one of claims 1 to 3 in which a bit allocation for only the random codebook is reduced to implement 6.4 kbit/s speech coding.

6. A speech coding method according to conjugate-structure algebraic code excited linear prediction, hereinafter referred to as CS-ACELP, in which an LSP coefficient, a pitch component vector, a random component vector, and gain vectors which are applied to the pitch component vector and the random component vector are coded using an LSP codebook, an adaptive codebook, a random codebook and a gain codebook, respectively, such that a distortion relative to an input speech waveform vector is minimized for each frame;

comprising the step of coding the random component vector such that each of random component vectors forming together the random codebook is formed of three or less pulses having a unit amplitude for each of a pair of subframes which form together a frame, the positions of the pulses being determined from a plurality of predetermined positions which a pulse can assume in a subframe so that a distortion in a synthesized speech is minimized;

wherein the gain codebook comprises a 6-bit vector quantized gain codebook.

7. A speech coding method according to conjugate-structure algebraic code excited linear prediction, hereinafter referred to as CS-ACELP, in which an LSP coefficient, a pitch component vector, a random component vector, and gain vectors which are applied to the pitch component vector and the random component vector are coded using an LSP codebook, an adaptive codebook, a random codebook and a gain codebook, respectively, such that a distortion relative to an input speech waveform vector is minimized for each frame;

comprising the step of coding the random component vector such that each of random component vectors forming together the random codebook is formed of three or less pulses having a unit amplitude for each of a pair of subframes which form together a frame, the positions of the pulses being determined from a plurality of predetermined positions which a pulse can assume in a subframe so that a distortion in a synthesized speech is minimized;

wherein the gain codebook comprises a (3+3)-bit conjugate-structure gain codebook.

8. A speech coding method according to claim 6 or 7, wherein said gain codebook is created by a learning process using a transmission bit error rate which is smaller than that employed in creation of a codebook by learning according to ITU-T Recommendation G.729.

9. A speech coding method according to claim 8, wherein said transmission bit error rate used in the creation of said gain codebook is smaller than 0.5%.

10. A speech coding method according to conjugate-structure algebraic code excited linear prediction, hereinafter referred to as CS-ACELP, in which an LSP coefficient, a pitch component vector, a random component vector, and gain vectors which are applied to the pitch component vector and the random component vector are coded using an LSP codebook, an adaptive codebook, a random codebook and a gain codebook, respectively, such that a distortion relative to an input speech waveform vector is minimized for each frame;

comprising the step of coding the random component vector such that each of random component vectors forming together the random codebook is formed of three or less pulses having a unit amplitude for each of a pair of subframes which form together a frame, the positions of the pulses being determined from a plurality of predetermined positions which a pulse can assume in a subframe so that a distortion in a synthesized speech is minimized;

wherein bits are allocated to the code of the pitch component vector without a parity bit.

11. A speech coding method according to claim 10 in which the LSP coding comprises the steps of coding in a first stage using a first LSP codebook, and coding in a second stage using a second LSP codebook, the number of bits in the second LSP codebook being less than the number of bits in the second LSP codebook according to ITU-T Recommendation G. 729 which is equal to 10.

12. A speech coding method according to claim 11 in which the second LSP codebook comprises a part of the second LSP codebook according to the ITU-T Recommendation G.729.

13. A speech coding method according to claim 11 in which the second LSP codebook comprises an LSP codebook which is prepared anew by a learning process.

14. A speech coding method according to one of claim 11, 12, and 13 in which each vector forming the second LSP codebook has a number of bits in either a lower order or a higher order or in both which is less than five bits.

15. A speech coding method according to claim 14 in which the random codebook comprises a random codebook formed by a shape codebook formed by random signals or exciting vectors which define pulse positions and which are prepared by a learning process, and the polarities of the pulses, thus enabling 6.4 kbit/s speech coding.

16. A speech coding method according to claim 14 in which the random codebook comprises a conjugate-structure random codebook which is represented in terms of a pair of sub-vectors, thereby enabling a 6.4 kbit/s speech coding.

17. A speech coding method according to claim 14 in which each random component vector in the random codebook comprises a pair of sub-vectors, each sub-vector comprising a pair of pulses having a unit amplitude thereby enabling a 6.4 kbit/s speech coding.

18. A. A speech coding method according to claim 14 in which each random component vector in the random codebook comprises a pair of sub-vectors, each sub-vector comprising three pulses having a unit amplitude, thereby enabling a 6.4 kbit/s speech coding.

19. A voice coding method according to claim 14 in which each random component vector in the random codebook comprises two sub-vectors, which may be selectively formed by two or three pulses each having a unit amplitude, thereby enabling a 6.4 kbit/s speech coding.

20. A speech coding method according to claim 14 in which the gain codebook comprises a (3+3)-bit conjugate-structure gain codebook.

21. A speech coding method according to claim 14 in which a search for the random component vector using the random codebook takes place by an orthogonalized search in which the random component vector is orthogonalized with respect to the pitch component vector when an optimum pitch gain has a value which exceeds a predetermined value, and takes place by a search without an orthogonalization when the pitch gain does not exceed the predetermined value.

22. A speech coding method according to conjugate-structure algebraic code excited linear prediction, hereinafter referred tp as CS-ACELP, in which an LSP coefficient, a pitch component vector, a random component vector, and gain vectors which are applied to the pitch component vector and the random component vector are coded using an LSP codebook, an adaptive codebook, a random codebook and a gain codebook, respectively, such that a distortion relative to an input speech waveform vector is minimized for each frame;

comprising the step of coding the random component vector such that each of random component vectors forming together the random codebook is formed of three or less pulses having a unit amplitude for each of a pair of subframes which form together a frame, the positions of the pulses being determined from a plurality of predetermined positions which a pulse can assume in a subframe so that a distortion in a synthesized speech is minimized;

wherein the LSP coding comprises the steps of coding in a first stage using a first LSP codebook, and coding in a second stage using a second LSP codebook, the number of bits in the second LSP codebook being less than the number of bits in the second LSP codebook according to ITU-T Recommendation G.279 which is equal to 10.

23. A speech coding method according to claim 22, in which the second LSP codebook comprises a part of the second LSP codebook according to the ITU-T Recommendation G.729.

24. A speech coding method according to claim 22 in which the second LSP codebook comprises an LSP codebook which is prepared anew by a learning process.

25. A speech coding method according to one of claim 22, 23 and 24 in which each vector forming the second LSP codebook has a number of bits in either a lower order or a higher order or in both which is less than five bits.

26. A speech coding method according to claim 25 in which the random codebook comprises a random codebook formed by a shape codebook formed by random signals or exciting vectors which define pulse positions and which are prepared by a learning process, and the polarities of the pulses, thus enabling 6.4 kbit/s speech coding.

27. A speech coding method according to claim 25 in which the random codebook comprises a conjugate-structure random codebook which is represented in terms of a pair of sub-vectors, thereby enabling a 6.4 kbit/s speech coding.

28. A speech coding method according to claim 25 in which each random component vector in the random codebook comprises a pair of sub-vectors, each sub-vector comprising a pair of pulses having a unit amplitude, thereby enabling a 6.4 kbit/s speech coding.

29. A speech coding method according to claim 25 in which each random component vector in the random codebook comprises a pair of sub-vectors, each sub-vector comprising three pulses having a unit amplitude, thereby enabling a 6.4 kbit/s speech coding.

30. A voice coding method according to claim 25 in which each random component vector in the random codebook comprises two sub-vectors, which may be selectively formed by two or three pulses each having a unit amplitude, thereby enabling a 6.4 kbit/s speech coding.

31. A speech coding method according to claim 25 in which the gain codebook comprises a (3+3)-bit conjugate-structure gain codebook.

32. A speech coding method according to claim 25 in which a search for the random component vector using the random codebook takes place by an orthogonalized search in which the random component vector is orthogonalized with respect to the pitch component vector when an optimum pitch gain has a value which exceeds a predetermined value, and takes place by a search without an orthogonalization when the pitch gain does not exceed the predetermined value.

33. A speech coding method according to conjugate-structure algebraic code excited linear prediction, hereinafter referred to as CS-ACELP, in which an LSP coefficient, a pitch component vector, a random component vector, and gain vectors which are applied to the pitch component vector and the random component vector are coded using an LSP codebook, an adaptive codebook, a random codebook and a gain codebook, respectively, such that a distortion relative to an input speech waveform vector is minimized for each frame;

comprising the step of coding the random component vector such that each of random component vectors forming together the random codebook is formed of three or less pulses having a unit amplitude for each of a pair of subframes which form together a frame, the positions of the pulses being determined from a plurality of predetermined positions which a pulse can assume in a subframe so that a distortion in a synthesized speech is minimized;

wherein the random codebook comprises a random codebook including a shape codebook formed by random signals or exciting vectors which define pulse positions and which are produced by a learning process, and the polarities of the pulses; and wherein a bit allocation for only the random codebook is reduced to implement 6.4 kbit/s speech coding.

34. A speech coding method according to conjugate-structure algebraic code excited linear prediction, hereinafter referred to as CS-ACELP, in which an LSP coefficient, a pitch component vector, a random component vector, and gain vectors which are applied to the pitch component vector and the random component vector are coded using an LSP codebook, an adaptive codebook, a random codebook and a gain codebook, respectively, such that a distortion relative to an input speech waveform vector is minimized for each frame;

comprising the step of coding the random component vector such that each of random component vectors forming together the random codebook is formed of three or less pulses having a unit amplitude for each of a pair of subframes which form together a frame, the positions of the pulses being determined from a plurality of predetermined positions which a pulse can assume in a subframe so that a distortion in a synthesized speech is minimized;

wherein the random codebook comprises a conjugate-structure random codebook which is represented in terms of a pair of sub-vectors; and wherein a bit allocation for the only random codebook is reduced to implement 6.4 kbit/s speech coding.

* * * * *